US006136437A

United States Patent [19]

Reither

[11] Patent Number: 6,136,437

[45] **Date of Patent: *Oct. 24, 2000**

[54] INDUSTRIAL FABRIC AND YARN MADE FROM AN IMPROVED FLUOROPOLYMER BLEND

[75] Inventor: John R. Reither, Summerville, S.C.

[73] Assignee: AstenJohson, Inc., Charleston, S.C.

[ * ] Notice: This patent issued on a continued prosecution application filed under 37 CFR 1.53(d), and is subject to the twenty year patent term provisions of 35 U.S.C. 154(a)(2).

[21] Appl. No.: 08/944,998

[22] Filed: Oct. 7, 1997

[51] Int. Cl.[7] ..... D02G 3/00; D03D 3/00; D03D 27/18; C08L 67/03

[52] U.S. Cl. ..... 428/373; 428/364; 428/365; 525/165; 525/174; 139/383 A; 442/199

[58] Field of Search ..... 525/165, 177, 525/174; 442/199; 428/364, 365, 373; 139/383 A

[56] References Cited

U.S. PATENT DOCUMENTS

| | | | |
|---|---|---|---|
| 4,505,982 | 3/1985 | Hoheisel | 428/421 |
| 5,283,110 | 2/1994 | Gardner et al. | 442/199 |
| 5,407,736 | 4/1995 | McKeon | 442/199 |
| 5,460,869 | 10/1995 | McKeon et al. | 442/199 |
| 5,472,780 | 12/1995 | Baris et al. | 428/364 |
| 5,489,467 | 2/1996 | McKeon et al. | 442/199 |
| 5,514,472 | 5/1996 | Baris et al. | 428/365 |

FOREIGN PATENT DOCUMENTS

| | | | |
|---|---|---|---|
| 9307829 B1 | 8/1993 | Rep. of Korea | D01F 8/14 |
| 9210607 | 6/1992 | WIPO | D21F 7/08 |
| 9505284 | 2/1995 | WIPO | B32B 27/36 |
| 9617019 | 6/1996 | WIPO | C08L 67/02 |

*Primary Examiner*—Richard Weisberger
*Attorney, Agent, or Firm*—Volpe and Koenig, P.C.

[57] ABSTRACT

Yarn that is a blend primarily of a fluoropolymer and, to a lesser extent, of an aromatic dicarboxylic acid polymer; also an industrial fabric, especially a papermaker's fabric.

21 Claims, No Drawings

INDUSTRIAL FABRIC AND YARN MADE FROM AN IMPROVED FLUOROPOLYMER BLEND

BACKGROUND OF THE INVENTION

The present invention relates generally to industrial fabrics and more particularly to papermaking fabrics.

Generally in the process for making paper, incremental amounts of liquid are removed from a slurry of pulp in a succession of steps. In a first forming step, the slurry is deposited on a porous forming fabric which drains much of the liquid by gravity and suction, and leaves a wet web of solids on the fabric surface. In a later pressing step, the wet web is compressed while on a press fabric in order to removed additional liquid. In a still later, drying step, more liquid is removed by evaporation, usually by supporting the web on a dryer fabric so that the web is in contact with large diameter, smooth, heated rolls.

The papermaking process places considerable demands on the fabrics used in each process step. The fabric should be structurally strong, flexible, abrasion resistant, chemical resistant, contamination resistant, and able to withstand high temperatures for extended times.

A major improvement in the technology of papermaking fabric has been the introduction of synthetic polymer monofilaments. A suitable polymer provides a yarn having mechanical and chemical properties which satisfy the requirements of automated fabric manufacturing and the demands of papermaking.

Fluoropolymer-based yarns are useful because of their high contaminant resistance. Ethylene tetrafluoroethylene polymer (ETFE), for example, is available and can be extruded into yarns. However, ETFE has poor mechanical properties and is difficult to draw without breaking. If one is able to draw the yarn at all, the mechanical properties of the yarn are poor. The poor mechanical properties of ETFE are not surprising given its low breaking or tensile strength.

In the present invention, it was discovered that the addition of an aromatic dicarboxylic acid polymer to a fluorocarbon polymer produces a blend with mechanical properties superior to that of the pure fluorocarbon polymer. Furthermore, the improvement in the mechanical properties, as measured by its breaking strength, was surprisingly large.

SUMMARY OF THE INVENTION

The present invention provides a yarn that is useful in industrial applications such as papermaking. The yarn is produced from a blend of a fluoropolymer as the major component and an aromatic dicarboxylic acid polymer as a minor component.

The invention includes industrial fabrics that are comprised of such yarns.

DETAILED DESCRIPTION OF THE PREFERRED EMBODIMENTS

Generally, the fluoropolymer and the aromatic dicarboxylic acid polymer will together make up about 100%, on a weight basis, of the yarn of the invention. They are preferably blended together so that the fluoropolymer is more than 70% by weight of the yarn but is not more than 99% by weight.

More specifically, the yarn is comprised of a fluoropolymer and an aromatic dicarboxylic acid polymer blend, wherein the fluoropolymer is one in which the fluorine atoms account for a substantial portion (at least 33%) of the molecular weight of the polymer and the aromatic dicarboxylic acid polymer is a polymer that comprises one or more aromatic dicarboxylic acids as repeating moieties within the polymer such that the ratio of fluoropolymer to aromatic dicarboxylic acid polymer is more than 70 to 30 but less than 99 to 1.

In one particular aspect, the yarn is a blend of a fluoropolymer and an aromatic dicarboxylic acid polymer. The fluoropolymer is one in which the fluorine atoms account for more then 50% of the molecular weight of the polymer. The aromatic dicarboxylic acid polymer is a polymer that comprises one or more aromatic dicarboxylic acids as repeating moieties within the polymer, wherein two successive aromatic dicarboxylic moieties are optionally separated by a linker moiety. On a weight basis, the fluoropolymer and the aromatic dicarboxylic acid polymer together are about 100% of the yarn and the ratio of fluoropolymer to aromatic dicarboxylic acid polymer is more than 70 to 30 but less than 99 to 1.

In a preferred embodiement, the yarn is one in which the ratio of fluoropolymer to aromatic dicarboxylic acid polymer is more than 75 to 25 but less than 95 to 5, more preferably less than 85 to 15. In a highly preferred embodiment, the ratio of fluoropolymer to aromatic dicarboxylic acid polymer is about 80 to 20.

As noted, it is a preferred aspect of the invention that each two successive aromatic dicarboxylic acid moieties are separated from each other by a linker moiety that is a dialkycycloalkyl, alkyl or alkene moiety. It is even more preferred that the linker moiety is selected from the group consisting of di($C_1$ to C6 alkyl) cyclohexane, $C_1$ to C6 alkyl, or $C_1$ to $C_6$ alkene.

A fluoropolymer of the present invention is one in which the fluorine atoms account for more than 50% of the molecular weight of the polymer. To illustrate, the repeat unit of homopolymer of 1, 1-difluoroethene, has two fluorine atoms (atomic weight contribution=38), two carbon atoms (atomic weight contribution=24), and two hydrogen atoms (atomic weight contribution=2). That contribution of fluorine atoms is 38/64, or 59%, of the molecular weight of the polymer is accounted for by the fluorine atoms. This calculation ignores the negligible contribution of the third carbon substituent at each end of the polymer.

Preferred fluoropolymers are:

—( $(CF_2—CH_2)_N—(CF_2—CF(CF_3))_M$)—, which is a fluorinated ethylenepropylene copolymer (FEP) available as Teflon FEP from Du Pont;

—$(CF_2—CFCl)_N$—, which is polytrifluorochloroethylene (PCTFE), available from 3M Corporation;

—$((CF_2—CF_2)_N—CF_2—CFO(C_ZF_{2z+1}))_M$—, which is a perfluoroalkoxy (PFA) polymer available as Teflon PFA from Du Pont; and ethylene tetrafluoroethylene polymer (ETFE) available as Tefzel fluoropolymer from Du Pont. ETFE is an alternating copolymer of ethylene and tetrefluoroethylene.

—$((CF_2—CH_2)_N$—, which is polyvinylidene fluoride, a homopolymer of 1,1-difluorethene, available as KYNAR from ELF Atochem North America, Inc., is not preferred as a papermaker's fabric.

The homopolymer of tetrafluoroethylene, —$(CF_2—CF_2)_N$—, available as Teflon from Du Pont, is a fluoropolymer whose fluorine atoms account for more than 50% of the weight of the polymer but is, poorly suited for the present invention.

Preferred aromatic dicarboxylic polymer for the present invention are PET, PBT, PMT, PEN, and PCTA.

Polyethylene terephthalate (PET) is a polymer wherein the linker group, when in the polymer, is considered herein to be a $C_2$ alkyl group, an alkyl group with two carbon atoms. PET is available as Crystar Merge 1929 from Du Pont.

Polybutylene terephtalate (PBT), is available as Valox 320 from General Electric and as Celanex 1600 from Hoechst Celanese.

Polytrimethylene terephthalate (PMT), is available as Coterra from Shell Chemical;

Polyethylene naphthalate (PEN), which is made from 2,6-naphthalene dicarboxylic acid, is available from Eastman Chemicals.

PCTA is a copolyester made substantially of two repeating units. One repeating unit (I) is copolymerized cyclohexane -1,4-dimethanol (CHOM) and copolymerized terephthalic acid. The second repeating unit (II) is copolymerized CHDM and a copolymerized aromatic dicarboxylic acid, especially isophthalic acid or phthalic acid, other than terephthalic acid. The ratio of I to II is most preferably between 0.90 and 0.99. PCTA production is discussed in U.S. Pat. No. 2,901,466. PCTA is available as Thermx 13319 from Eastman Chemical.

"$C_1$ alkyl" refers to an alkyl moiety with one carbon atom, "$C_2$ alkyl" refers to an alkyl moiety with two carbon atoms, and so on. "Cycloalkyl" refers to a nonaromatic cycloalkyl moiety, especially cyclopentyl or cyclohexyl.

Aromatic moieties of aromatic dicarboxylic acid esters are preferably single ring (benzene) or two rings (naphthalene).

Preparation of monofilament used in the examples

Monofilaments of the present invention were prepared using conventional monofilament production equipment. ETFE and the PET were supplied as particles in commercially available granular or pellet form. The particles were melt blended. The melt was filtered through a screen pack, extruded through a multihole die, quenched to produce strands, drawn and heatset to the final form monofilament.

The meltblend phase included passage through four barrel zones in sequence, a barrel neck, a pump, a screen pack, and the front and back of the multi-hole die, each of whose temperatures was monitored and specified in the examples below.

Quenching was done in a water bath. The strands were drawn through three ovens in sequence. The ovens were separated by a "cold zone", which was a zone at room temperature about 25° C. The four godets used to control the draw ratios and final relaxation were located before the first oven, in the two cold zones, and after the third oven.

Additional process details are given in the examples.

Conversion of monofilament to industrial fabric

The monofilament yarn of the present invention can be made into industrial fabric by conventional methods. It can be woven on looms in the traditional warp and fill fabric structure or formed into spiral structures in which parallel monofilament spirals are intermeshed with pintle yarns. The fabric of this invention can be formed exclusively from the monofilament yarn of this invention or from that yarn in combination with other materials. A preferred use for the fabric of this invention is in the papermaking process.

Tests used in the examples to measure filament properties

Tensile strength and related properties were measured on a tensile testing machine operated with a ten (10) inch/minute jaw separation rate with a maximum load of 100 pounds.

Elongation was measured as the percent increase in length at a fiber loading of 1.75 g/d.

Tenacity, in grams/denier, was measured as the normalized tensile force required to break a single filament.

Breaking strength was measured as the tensile force required to break a single filament.

Breaking energy, in kg-mm, was measured as the area under the stress strain curve.

Breaking elongation was measured as the percentage increase in length at the tensile force required to break a single filament.

Knot strength was the tensile force necessary to break an overhead knotted filament.

Knot elongation was measured as the percentage increase in length at the break point of the knot. This is a measure of the toughness of the yarn.

For the loop strength measurement, interlocking loops were formed with two monofilaments and the ends of each monofilament were clamped in the jaws of a tensile tester. Loop strength was the force necessary to break the interlocked loops.

Loop elongation was measured as the percentage increase in length at the point at which the yarn breaks in the loop configuration.

Modulus was measured as the slope of the stress/strain curve at one percent (1%) strain.

Knot strength, knot elongation, loop strength, loop elongation, and modulus were each measured in a manner consistent with ASTM test D2256.

Free shrink was measured as percent dimensional change after unrestrained exposure to 204° C. for 15 minutes.

Abrasion testing was performed at room temperature (25° C.) and ambient humidity (50%) by suspending a 200 g or 500 g weight from the end of a sample filament draped in an arc contacting with the surface of a revolving "squirrel cage" cyclinder. The surface of the "squirrel cage" was comprised of approximately 36 evenly spaced 24 gauge, stainless steel wires. Abrasion resistance was measured as the number of revolutions, at a constant rotation speed, required to cause the sample filament to break.

EXAMPLES

The present invention will be more fully understood by reference to the following representative examples. Unless otherwise indicated, all parts, proportions and percentages are by weight.

Example 1

Run A:

A blend of 80% by weight ETFE and 20% by weight PET was extruded. The ETFE was Tefzel 2185 (from DuPont) with a melt flow rate of 11.0 g/10 minutes. The PET was a DuPont polyester, Crystar merge 1929. The PET resin has an inherent viscosity of 0.95. During this trial a 0.5 mm yarn was produced. The process used in making this yarn is shown in Table 1 below. The initial draw ratio was 5.4:1. The yarn could be drawn at even higher levels but at those levels the yarn appeared to be drawing prior to the first oven and seemed to have a tendency to fibrillate when broken during mechanical testing. Under the conditions used in this run, such "cold drawing" was not observed and the yarn appeared to have a good balance of properties.

TABLE 1

| process condition | run B 80% ETFE 20% PET 0.30 × 1.06 mm | run A 80% ETFE 20% PET; 0.5 mm |
|---|---|---|
| barrel zone 1 | 588.1° F. | 589.4° F. |
| barrel zone 2 | 619.7° F. | 619.0° F. |
| barrel zone 3 | 588.8° F. | 600.2° F. |
| barrel zone 4 | 579.3° F. | 600.2° F. |
| neck | 581.4° F. | 599.5° F. |
| pump | 579.3° F. | 600.2° F. |
| die back | 599.5° F. | 599.5° F. |
| die front | 598.9° F. | 602.2° F. |
| pack | 599.5° F. | 599.5° F. |
| quench | 115.9° F. | 139.8° F. |
| oven 1 | 224.6° F. | 209.9° F. |
| oven 2 | 274.8° F. | 275.3° F. |
| oven 3 | 399.9° F. | 399.9° F. |
| godet 1 | 27.5 fpm | 25 fpm |
| godet 2 | 135.0 fpm | 135 fpm |
| godet 3 | 160.0 fpm | 140 fpm |
| godet 4 | 135.0 fpm | 120 fpm |
| 1st draw ratio | 4.9:1 | 5.4:1 |
| 2nd draw ratio | 1.19:1 | 1.04:1 |
| % relaxation | 15.6% | 14.3% |
| extruder speed | 31.8 rpm's | 31.5 rpm's |
| extruder amps | 35.1 | 37.6 |
| spin pump speed | 75.0 $cm^3$/min | 59.8 $cm^3$/min |
| spin pump amps | 53.6 | 42.6 |
| extruder pressure #1 | 865 psi | 1026 psi |
| extruder pressure #2 | 2243 psi | 2228 psi |
| melt temperature 2 | 594.1° F. | 599.5° F. |

The yarn properties for the ETFE/PET blend (run A) are shown in Table 2 below. Those for ETFE (Tefzel) are shown in Table 3 below. The key difference is the breaking strength. The sample manufactured with ETFE/PET had twice the breaking strength of the ETFE sample. Also, the ETFE/PET blend had a significantly smoother surface and was free of slubs (unoriented areas). The ETFE sample was very non-uniform and had many slubs.

TABLE 2

| yarn Property | run A 0.5 mm 80% Tefzel 2185/20% PET | run B 0.25 × 0.85 mm Tefzel 2185/20% PET |
|---|---|---|
| diameter | 0.5 | 0.25 × 0.85 mm |
| denier | 2903 | 2628 |
| elong @ 1.75 g/d | 15.9% | 12.3% |
| breaking energy | 336.8 kg-mm | 247.3 kg-mm |
| tenacity | 2.61 g/d | 2.80 g/d |
| breaking strength | 16.7 pounds | 16.2 pounds |
| breaking elongation | 27.5% | 20.6% |
| modulus | 30.1 g/d | 34.1 g/d |
| elongation @ 1.0 pounds | 0.5% | 0.5% |
| abrasion | n/a | 14167/12267 |
| free shrink @ 204° C. | n/a | 4.9% |
| loop strength | 26.8 pounds | 17.6 pounds |
| loop elongation | 19.4% | 11.0% |
| knot strength | 11.0 pounds | 13.6% |
| knot elongation | 17.7% | 19.0% |

TABLE 3

| yarn Property | Kynar 720 run 30332 | Tefzel 210 |
|---|---|---|
| diameter | 0.30 × 1.06 mm | 0.30 × 1.06 mm |
| denier | 3552 | 3439 |
| elong @ 1.75 g/d | 12.6% | n/a |
| breaking energy | 260 kg-mm | 243.4 kg-mm |

TABLE 3-continued

| yarn Property | Kynar 720 run 30332 | Tefzel 210 |
|---|---|---|
| tenacity | 2.97 g/d | 1.16 g/d |
| breaking strength | 23.2 pounds | 8.8 pounds |
| breaking elongation | 19.8% | 30.6% |
| modulus | 13.6 g/d | 24.5 g/d |
| elongation @ 1.0 pounds | 0.9% | 0.5% |
| abrasion | 9872 | n/a |
| free shrink @ 204° C. | melts | 15% |
| loop strength | 22.2 pounds | n/a |
| loop elongation | 13.6% | n/a |
| knot strength | n/a | n/a |
| knot elongation | n/a | n/a |

Run B:

This was a trial to run a flat warp yarn product. Process conditions are shown in Table 1 above. Based on the success with the 0.5 mm yarn, it was decided to try to run a warp yarn to determine if the same type of performance would be seen in a flat product. In the past better success had been achieved running a round ETFE product than a flat product. During this run, the flat product displayed essentially the same extrusion performance as the round product. The yarn surface of the flat product was very smooth and the yarn was easy to draw. In this run, the 2nd draw ratio was increased but no yarn breaks occurred.

Yarn properties were even better with the flat yarn. The tenacity was 8% higher due to the increased draw ratio. The yarn properties measured are shown in Table 2 above.

An attempt was made to increase the percentage of PET to 30%. At this level the two resins appeared to be incompatible. The resin was pulsating out of the spinneret, constantly changing dimensions. This is typical of an incompatible blend. As a result, the attempt to produce a yarn at the 30% PET level was unsuccessful.

Run C:

The purpose of this trial was basically to duplicate run B. The goal was to manufacture samples of a 0.30×1.06 mm yarn. During run 30488 the last godet speed was adjusted without adjusting the spin pump speed. As a result the yarn cross section (0.25 mm×0.85 mm) was much smaller than anticipated. There were no problems producing the yarn using this process (Run C). Table 4 below lists the process conditions.

TABLE 4

| process conditions | run C 80% ETFE 20 % PET; 0.30 × 1.06 mm |
|---|---|
| barrel zone 1 | 578.7° F. |
| barrel zone 2 | 618.4° F. |
| barrel zone 3 | 589.4° F. |
| barrel zone 4 | 592.1° F. |
| neck | 579.3° F. |
| pump | 579.3° F. |
| die back | 599.5° F. |
| die front | 599.5° F. |
| pack | 599.5° F. |
| quench | 115.5° F. |
| oven 1 | 224.6° F. |
| oven 2 | 274.8° F. |
| oven 3 | 399.4° F. |
| godet 1 | 27.5 fpm |
| godet 2 | 135 fpm |
| godet 3 | 160 fpm |
| godet 4 | 135 fpm |

TABLE 4-continued

| process conditions | run C 80% ETFE 20 % PET; 0.30 × 1.06 mm |
|---|---|
| 1st draw ratio | 4.9:1 |
| 2nd draw ratio | 1.19:1 |
| % relaxation | 15.6% |
| extruder speed | 41 rpm's |
| extruder amps | 38.4 |
| spin pump speed | 103.9 $cm^3$/min |
| spin pump amps | 57.3 |
| extruder pressure #1 | 2482 psi |
| extruder pressure #2 | 1583 psi |
| melt Temperature 2 | 598.2° F. |

The yarn properties made during this trial are shown in Table 5 below. The yarn compared very favorably to Kynar yarn (Table 3 above), and the ETFE/PET blend had a much higher melting point than the Kynar yarn. During the 204° C. free shrinkage test, the Kynar yarn melted but the ETFE/PET yarn was unaffected by this temperature.

The ETFE/PET yarn had very good mechanical properties. The breaking strength was 23 pounds. As the breaking strength of Tefzel 2185 yarn is only 8.8 pounds, and the breaking strength of PET yarn is about 27 pounds, it was suprising that only 20% PET was needed to achieve an increase of the breaking strength to 23 pounds. The breaking energy was over 400 kg-mm. The only concern regarding this yarn was the abrasion resistance. The abrasion resistance test was run using a 200 gram weight. Typically the test would be run using a 500 gram weight, but with a 500 gram weight the abrasion resistance was about 2000 cycles to break. PET has an abrasion resistance of about 10,000–20,000 cycles to break using the 500 gram weight. If the ETFE/PET yarn is to be used in an abrasion prone position it may pose some problems. The abrasion resistance can be improved by decreasing the draw ratio (i.e. conditions that create a yarn with a lower breaking strength) or perhaps altering the ratio of the two polymers.

The blend also had excellent loop strength and knot strength. The loop strength of the yarn was 23 pounds with 15% elongation. This is very close to that of PET (25–30 pounds). Part of the reason is that the denier is so much higher, due to the higher density of the ETFE. The knot strength was also observed to be very high for this yarn. The knot strength was measured as 16 pounds and the elongation at break as 20.2%. This indicates that the yarn is very ductile at least when under tension. Table 5 above compares the properties of the ETFE/PET blend with a PET yarn.

In summary, the incorporation of 20% PET into ETFE makes a yarn that has a very smooth surface with a significant improvement in yarn properties. The resulting blend is easy to process and draws very readily. At 30% PET in ETFE, however, the resulting yarn is very rough and does not orient at all.

Special corrosive-resistant tooling (spinnerets, screws, die components etc.) may be needed to optimally implement the current invention as the fluoropolymer material is very corrosive to standard tool steel.

TABLE 5

| yarn Property | standard PET | run C 0.30 × 1.06 Tefzel 2185/20% PET |
|---|---|---|
| diameter | 0.30 × 1.06 mm | 0.30 × 1.06 mm |
| denier | 2870 | 3622 |
| elong @ 1.75 g/d | 8.5% | 13.1% |

TABLE 5-continued

| yarn Property | standard PET | run C 0.30 × 1.06 Tefzel 2185/20% PET |
|---|---|---|
| breaking energy | 642 kg-mm | 406.5 kg-mm |
| tenacity | 4.28 | 2.91 g/d |
| breaking strength | 27.0 pounds | 23.2 pounds |
| breaking elongation | 32.9% | 23.1% |
| modulus | 59.8 g/d | 31.9 g/d |
| elongation @ 1.0 pounds | 0.3% | 0.4% |
| abrasion | 12800 (500 gram) | 16642 (200 gram) |
| free shrink @ 204° C. | 6.0% | 7.5% |
| loop strength | 27.2 pounds | 23.2 pounds |
| loop elongation | 21.3% | 15.2% |
| knot strength | 17.6 pounds | 16.2 pounds |
| knot elongation | 22.7% | 20.2% |

* * *

I claim:

1. An industrial fabric including a yarn comprising a blend of 70–99% by weight fluoropolymer and 30–1% by weight polyetheylene terephthalate (PET), wherein the fluorine atoms in the fluoropolymer account for more than 33% of the number average molecular weight of the fluoropolymer.

2. The fabric of claim 1 wherein the fluoropolymer is 75–95% by weight and the PET is 25–5% by weight.

3. The fabric of claim 1 wherein the fluoropolymer is 75–85% by weight and the PET is 25–15% by weight.

4. The fabric of claim 1 wherein the fluoropolymer is about 80% by weight and the PET is about 20% by weight.

5. The fabric of claim 1 wherein the fluoropolymer is ethylene tetrafluorethylene (ETFE).

6. The fabric of claim 5 wherein the ETFE is 75–95% by weight.

7. The fabric of claim 5 wherein the ETFE is 75–85% by weight.

8. The fabric of claim 5 wherein the ETFE is abou t80% by weight and the PET is about 20% by weight.

9. The industrial fabric of claim 1 wherein the fabric is a papermaking fabric.

10. The fabric of claim 9 wherein the fabric is a papermaker's forming fabric.

11. The fabric of claim 9 wherein the fabric is a papermaker's dryer fabric.

12. The fabric of claim 9 wherein the fabric is a papermaker press fabric.

13. A yarn comprising a blend of 70–99% by weight fluropolymer and 30–1% by weight polyetheylene terephthalate (PET), wherein the fluorine atoms in the fluoropolymer account for more than 33% of the number average molecular weight of the fluoropolymer.

14. The yarn of claim 13 wherein the fluoropolymer is 75–95% by weight and the PET is 25–5% by weight.

15. The yarn of claim 13 wherein the fluoropolymer is 75–85% by weight and the PET is 25–15% by weight.

16. The yarn of claim 13 wherein the fluoropolymer is about 80% by weight and the PET is about 20% by weight.

17. The yarn of claim 13 wherein the fluoropolymer is ethylene tetrafluorethylene (ETFE).

18. The yarn of claim 17 wherein the ETFE is 75–95% by weight.

19. The yarn of claim 17 wherein the ETFE is 75–85% by weight.

20. The yarn of claim 17 wherein the ETFE is about 80% by weight.

21. The yarn of claim 13 wherein the fluorine atom account for more than 50% of the molecular weight of the fluoropolymer.

* * * * *